US008991063B2

(12) United States Patent
Eckhart

(10) Patent No.: US 8,991,063 B2
(45) Date of Patent: Mar. 31, 2015

(54) PORTABLE TARGET

(76) Inventor: David J. Eckhart, Pottstown, PA (US)

( * ) Notice: Subject to any disclaimer, the term of this patent is extended or adjusted under 35 U.S.C. 154(b) by 126 days.

(21) Appl. No.: 13/446,487

(22) Filed: Apr. 13, 2012

(65) Prior Publication Data

US 2013/0269193 A1 Oct. 17, 2013

(51) Int. Cl.
*F41J 3/00* (2006.01)

(52) U.S. Cl.
CPC ..... *F41J 3/0004* (2013.01)
USPC ..... 33/293; 33/506; 273/407; 273/410

(58) Field of Classification Search
CPC ..... F41J 3/0004
USPC ..... 33/293; 273/404, 407, 410
See application file for complete search history.

(56) References Cited

U.S. PATENT DOCUMENTS

| | | | | | |
|---|---|---|---|---|---|
| 1,602,441 | A | * | 10/1926 | Ellis | 273/404 |
| 3,476,390 | A | * | 11/1969 | Roloff et al. | 273/404 |
| 3,902,721 | A | * | 9/1975 | Piccini | 273/404 |
| 4,546,984 | A | * | 10/1985 | Towle et al. | 273/404 |
| 4,695,060 | A | * | 9/1987 | Pilgrim | 273/404 |
| 5,354,066 | A | * | 10/1994 | Swanson et al. | 273/408 |
| 5,577,734 | A | * | 11/1996 | Conroy | 273/407 |
| 5,649,708 | A | * | 7/1997 | Podlesny | 273/403 |
| 5,669,836 | A | * | 9/1997 | Hill | 473/574 |
| 5,671,924 | A | * | 9/1997 | Scott | 273/407 |
| 5,678,824 | A | * | 10/1997 | Fortier et al. | 273/407 |
| 5,860,655 | A | * | 1/1999 | Starrett | 273/408 |
| 2009/0008878 | A1 | * | 1/2009 | Jones | 273/404 |

* cited by examiner

*Primary Examiner* — Christopher Fulton
(74) *Attorney, Agent, or Firm* — Saul Ewing LLP; Stephen J. Driscoll

(57) ABSTRACT

A portable target comprising: (a) a complaint, energy-absorbing backer; (b) a target on a surface of said backer; and (c) a support mechanism for holding said surface of said backer in a vertical position.

21 Claims, 3 Drawing Sheets

PORTABLE TARGET

FIELD OF INVENTION

The present invention relates generally to a portable target, and, more specifically, to a portable target that is suitable for calibrating bows and other archery paraphernalia in the field.

BACKGROUND

Hunting is an important tradition, recreation, and livelihood in the lives of many. Of particular interest herein is bow hunting. Today's serious bow hunters carry sophisticated bows and precisely balanced arrows. For example, a commonly used bow is a compound bow, which has a complex mechanism of pulleys to achieve mechanical advantages, and a sophisticated sight. The sight is usually adjustable to compensate for environmental conditions, such as wind and humidity, as well as for variations in the bow itself, such as, for example, stretching of the cord as a result of being under constant stress, and stiffness variability in the bow as a result of continued use and temperature fluctuations.

The sight should be calibrated periodically to ensure accuracy. Periodic calibration is required because, over time and with use, the above-mentioned variations become significant to the point that the accuracy of the weapon is compromised. Additionally, often bows are knocked about as they are carried through rough terrain and used in rugged conditions. Such jarring can affect the components of the bow and the accuracy of the sights.

Calibrating the sight is generally a straightforward procedure. It involves standing a certain distance from a target, shooting an arrow at a particular point on the target according to the bow's sight, measuring the offset between the particular point on the target and the point at which the arrow actually hits the target, and adjusting the sight accordingly. Generally, such sight calibration is routine and readily performed using a stationary target having a thick, compliant backing to absorb the energy of arrow to avoid damaging the arrow. Being able to absorb the energy of the arrow without damaging the arrow is critical because arrows can be expensive and are not considered disposable.

Ordinarily, calibrating sights is not a problem because of the availability of stationary targets which are backed with a compliant material, such as foam rubber or straw, which absorb the energy of the arrow with little or no damage. However, such calibration can be far more difficult in the field where such stationary targets are not available. For example, often on hunting excursions, hunters will venture into remote areas for days and will have no access to such targets. The problem is exacerbated by the fact that, during these hunting excursions, the bows are subjected to rough handling and more frequent use which tends to increase the variables that diminish sight accuracy as described above. Faced with this problem, hunters are often forced to calibrate their sights by shooting arrows into fabricated backstops which often damage the arrows making them unusable.

Therefore, there is a need for a target system for bows which is portable and which does not damage the arrows. The present invention fulfills this need among others.

SUMMARY OF INVENTION

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

The present invention provides a portable target having a compliant backer. The complaint backer not only absorbs the energy of an arrow, thereby protecting the arrow from damage, but also enables the target to be easily folded, packed and transported during extended hunting trips. In other words, the compliance of the backer synergistically allows for easy stowage for portability and energy absorption to avoid arrow damage.

Accordingly, one aspect of the invention is a portable target having a compliant, energy absorbing backer. In one embodiment, the portable target comprises: (a) a complaint, energy-absorbing backer; (b) a target on a surface of the backer; and (c) a support mechanism for holding the surface of the backer in a vertical position.

Another aspect of the invention is a method of using the portable target to calibrate the sight of a bow. In one embodiment, the method comprises: (a) unfurling a backer of a portable target; (b) presenting a target on a side of the backer; (c) supporting the backer in a vertical position; (d) while standing a certain distance away from the target, shooting an arrow with a flat tip at a certain point in the target; (e) measuring the distance between the certain point and a point of impact of the arrow; and (f) adjusting the sight based on the distance.

DETAILED DESCRIPTION

Figure 1:
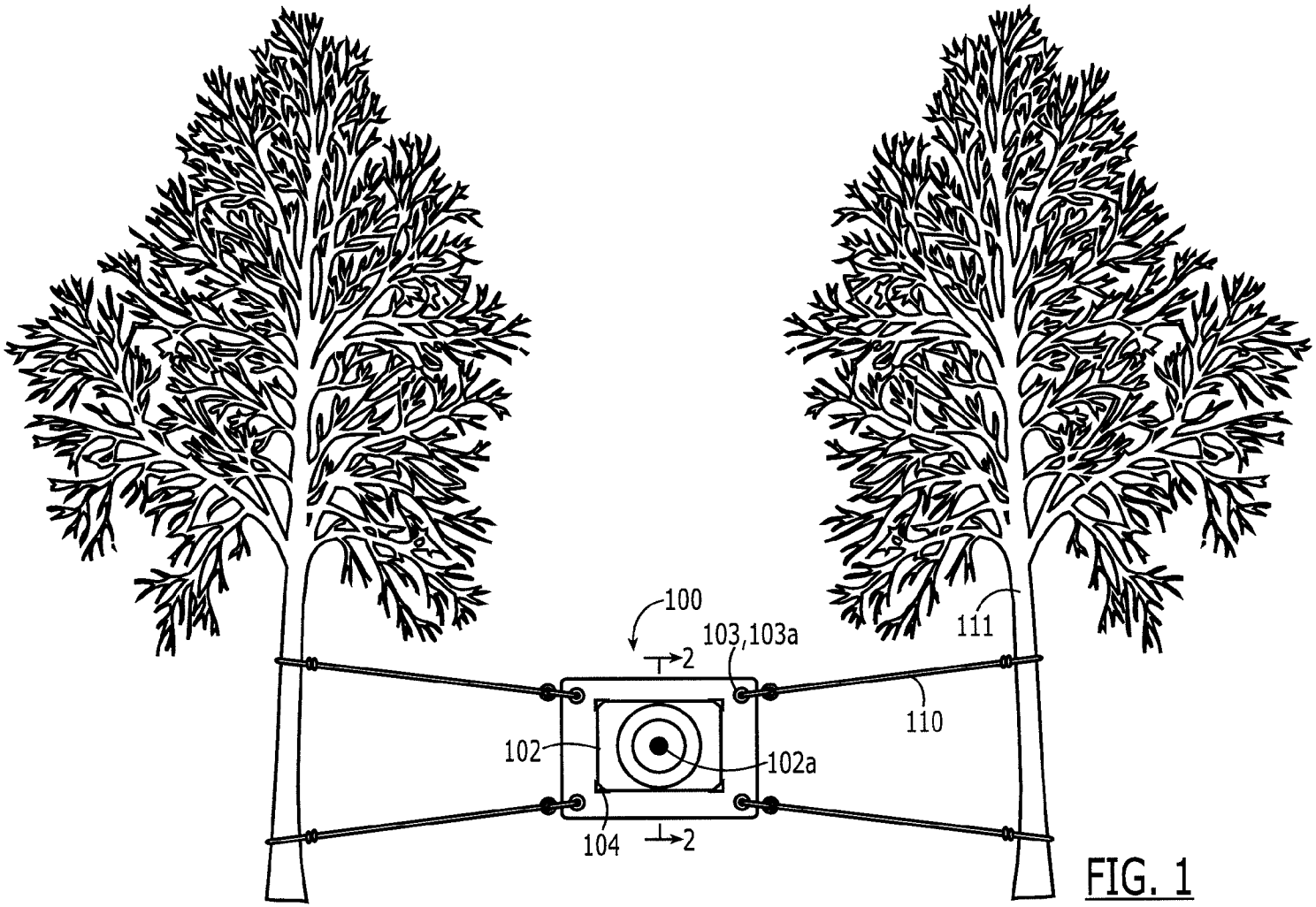
FIG. 1 shows one embodiment of the portable target of the present invention.
Figure 2:
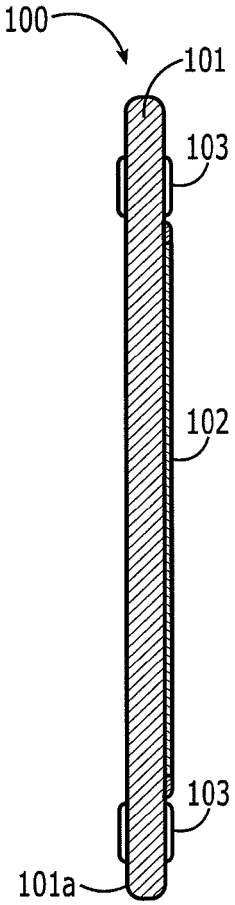
FIG. 2 shows a cross-sectional view of the portable target of FIG. 1.

Referring to FIG. 1, one embodiment of the portable target 100 of the present invention is shown. The portable target 100 comprises a complaint, energy-absorbing backer 101, a target 102 on a surface 101*a* of the backer 101; and a support mechanism 103 for holding the surface of the backer in a vertical position.

The portable target 100 is well suited for calibrating the sight of a bow in the field. To this end, in one embodiment, calibrating the sight in the field comprises: (a) unfurling the backer 101 of the portable target 100; (b) presenting a target 102 on a side 101*a* of the backer 101; (c) supporting the backer 101 in a vertical position; (d) while standing a certain distance away from the target (e.g., twenty yards), shooting an arrow (not shown) with a flat tip at a certain point (e.g. bull's eye 102*a*) in the target 102; (e) measuring the offset between the certain point and a point of impact of the arrow; and (f) adjusting the sight based on the offset.

These elements are described below and with greater detail with respect to exemplary embodiments. It should be understood that, although a compound bow was mentioned particularly above, the invention is not limited to compound bows and may be used with any bow, such as, for example, long bows, cross bows, and recurve bows. Furthermore, although the invention is ideally suited for calibrating the sight of the bow in the field, it is not limited to calibrating sights and may be used for simple target practice with bows regardless of whether they have sights.

The backer 101 functions to present the target 102 and to absorb the energy of the arrow upon impact. To this end, Applicant recognizes that the energy in the arrow needs to be transferred from the arrow to the backer over a minimum distance. If the distance is too short, the energy of the arrow may be dissipated by fracturing the arrow or in some other destructive way. Longer stop distances reduce the chance of arrow damage.

The backer 101 may have different embodiments provided it absorbs the energy of an arrow as discussed above. For example, the backer may be configured to comply with the tip of the arrow and bend and move, thereby gradually stopping the arrow by transferring energy from the arrow into the backer over a distance, which is then dissipated through the support mechanism or through windage or other friction source. Energy may also be absorbed by transferring the energy of the arrow into a complaint material via the deformation of the compliant material. For example, in this configuration, the backer 101 may configured as a bag defining an interior space filled with compliant material such that, upon impact, the compliant material deforms thereby absorbing the energy of the arrow. Still other ways of absorbing the energy of an arrow will be obvious to one skilled in the art in light of this disclosure.

In the embodiment shown in FIG. 1, the backer comprises a relatively thin, pliable material, which absorbs energy by being compliant about the tip of the arrow and being free to bend and move to slow the arrow down as described above. Suitable compliant materials should be tough to avoid puncture by the arrow, but pliable to move as described above. Generally, the material ought to have toughness sufficient to withstand puncturing from an arrow with a flat tip traveling no less than 250 feet per second, and in a more specific embodiment no less than 350 feet per second.

Suitable materials include, for example, films/sheets of natural and synthetic rubbers and other polymeric materials (e.g., polyethylene sheet, and copolymer of ethylene and propylene rubber, synthetic rubber such as ethylene-propylene copolymer, polyacrylate rubber, ethylene-acrylate rubber, polyester urethane, bromo isobutylene isoprene, polybutadiene, chloro isobutylene isoprene, polychloroprene, chlorosulphonated polyethylene, epichlorohydrin, ethylene propylene, ethylene propylene diene monomer, polyether urethane, perfluorocarbon rubber, fluoronated hydrocarbon, fluoro silicone, fluorocarbon rubber, hydrogenated nitrile butadiene, polyisoprene, isobutylene isoprene butyl, acrylonitrile butadiene, polyurethane, styrene butadiene, styrene ethylene butylene styrene copolymer, polysiloxane, vinyl methyl silicone, acrylonitrile butadiene carboxy monomer, styrene butadiene carboxy monomer, thermoplastic polyether-ester, styrene butadiene block copolymer, and styrene butadiene carboxy block copolymer); woven and nonwoven fabrics comprising high strength fibers (for example, polyparaphenylene terephthalamide (e.g., Kevlar®), polyamides (e.g., Nylons), and fabrics of common, tough materials such as canvas. In one specific embodiment, the backer comprises a fabric of poly-paraphenylene terephthalamide fibers.

Figure 3:
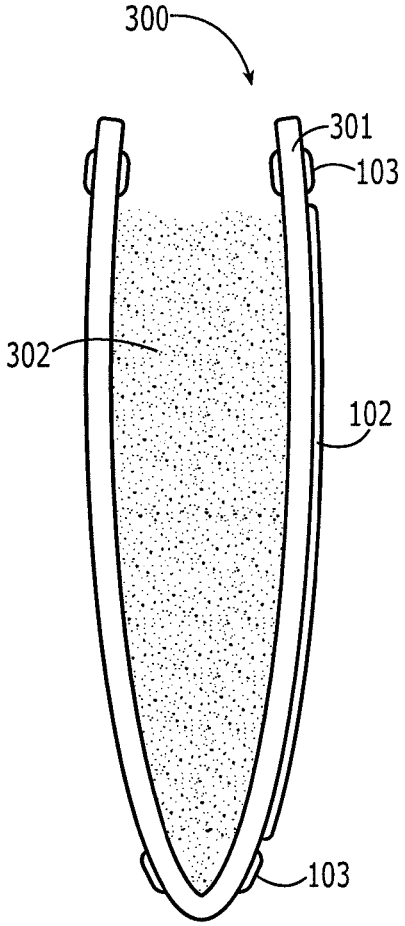
FIG. 3 shows an alternative embodiment of the backer of the portable target.

Referring to FIG. 3, an alternative embodiment of the target 300 is shown in which the backer 301 is configured essentially as a bag to define a cavity 303 to hold compliant material 302, which absorbs the energy of the arrow by deforming as described above. Suitable filler material may include, for example, items found in the forest such as grass, foliage, water or dirt. Alternatively, the filler material may be items typically carried by a hunter over an extended period, including, for example, socks, underwear and other soft compliant material. In yet another embodiment, the cavity may be filed with an elastic polymeric material. The cavity 303 may be left open as shown to allow the user to fill and empty the backer 301 as needed, or the cavity 303 may be filed permanently and sealed (e.g., sewed shut). Alternatively, the backer 301 may comprise a zipper or other seam closing mechanism to close the cavity 303. Still other embodiment will be obvious to those of skill in the art in light of this disclosure.

The function of the portable target 102 is to provide an accurate indication of where the tip of the arrow strikes the portable target. The target should be compliant so as to move with the backer to absorb the energy of an arrow as described above.

Many embodiments of the target exist. For example, it may be a traditional target with a bull's eye in concentric rings around the bull's eye to indicate offset from the bull's eye. Alternatively, the target may be a plain sheet, without any markings in which case the user would shoot an initial arrow at the target, and then shoot a second arrow at the same spot the initial arrow hit to determine offset for purposes of calibrating the sights. In yet another embodiment, the target is marked on the surface 101*a* of the backer 101, or the surface 101*a* is coated with a material that reveals where an arrow hits. Still other embodiments of the target will be known to those of skill in the art in light of this disclosure.

In one embodiment, the target is disposable such that one sight calibration secession does not interfere with another. Specifically, given that the markings of a particular calibration session must be distinct from other marks in order to readily judge the offset and calibrate the sights accordingly, generally speaking, once a target is used for a calibration session, it is preferable, although not necessary, that it be discarded or otherwise cleared of prior hits. Accordingly, the targets ought to be made from a relatively inexpensive material such as paper or fabric and be pliable so as to be easily carried and stowed. In other embodiment, the target is configured to be wiped clean of previous marks. Accordingly, the target in such an embodiment ought to be erasable.

In one embodiment, the target is configured to indicate a mark at the point of impact with the tip of the arrow. This can be achieved in different ways. For example, traditional "carbonless" layered paper may be used in which an encapsulated material in one layer is released upon impact to react with a developer in another layer to create a mark. Such coated papers are well known in the art. Alternatively, a simple two-sheet target may be used in which the first layer is a distinctly different color from the second layer such that the impact of the arrow on the target reveals the second layer and thereby provides a visible mark of where the arrow tip impacted the target. In still another embodiment, the backer is a distinct, contrasting color from the target and the target is configured to be pierced at the point of impact to reveal the contrasting backer underneath. Still another embodiment involves coating the tips of the arrows with a material that marks the surface 101*a* of the backer 100. In such an embodiment, the target will be the surface 101*a* of the backer 101.

If the target 102 is a discrete component from the backer 101, then an attachment mechanism 103 is used to secure the target to the backer. Various embodiments of the attachment mechanism exist. For example, the attachment mechanism may be a form of a releasable adhesive on the back of the target 102, or the attachment mechanism may be in the form of a mechanical component, which attaches the target to the backer 101. Still other embodiments will obvious to one of skill in the art in light of this disclosure.

Referring to FIG. 1, the attachment mechanism 103 is embodied in a releasable adhesive layer (not shown) on the back of the target 102, which adheres the target to the backer 101. In one embodiment, the adhesive layer is concealed/protected by a disposable sheet or film, which, when removed, reveals the adhesive layer on the target 102. Preferably, the adhesive is a light-stick, releasable adhesive which are commercially available. Such light-adhesives allow the target to be secured to the backer 101 and then removed from the backer 101 without leaving an adhesive residue behind.

Figure 4:
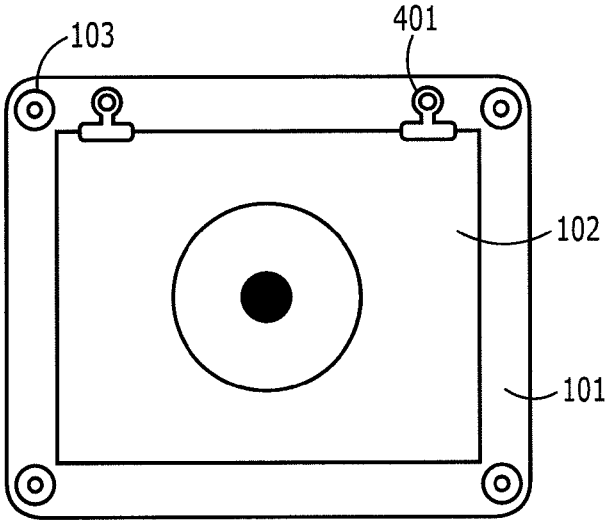
FIG. 4 shows an alternative embodiment of the attachment mechanism of the portable target.

Alternatively or in conjunction with the adhesive layer, the attachment mechanism may be in the form of a mechanical interconnect. Suitable mechanical interconnects include, for example, clips, posts, snaps, hook and loop fasteners, pockets, and any other known device for securing one pliable material to another. In the embodiment of the target 400 shown in FIG. 4, clips 401 are disposed at the top portion of the backer 101 and are configured to clip the target 102 to the backer as shown. In yet another embodiment, the attachment mechanism is integral with the backer 101. For example, the backer 101 may have defined on its surface 101*a* one or more pockets 104 to receive and hold a portion of the target as shown in FIG. 1. In one specific embodiment, the attachment mechanism comprises four pockets, each pocket positioned to receive a corner of the target. Still other embodiments of the attachment mechanism will be known to those of skill in the art in light of this disclosure.

The support mechanism serves to hold the backer and target in an upright position such that the user can aim at the target from a certain distance. Various embodiments of the support mechanisms exist. For example, in one embodiment, the support mechanism comprises a purchase point on the target from which the target can be hung or otherwise held up. Suitable purchase points include, for example, grommets, cleats, tabs, loops, or other structures known for providing a purchase point. In the embodiment shown in FIG. 1, the support mechanism 103 comprises grommets 103*a* as shown. The purchase point provides a location on the backer 101 to which a line 110 or similar device may be attached and then secured to a stationary object found in the field, such as, for example, a tree 111, bush, fence or other structure common in the outdoors.

Figure 5A:
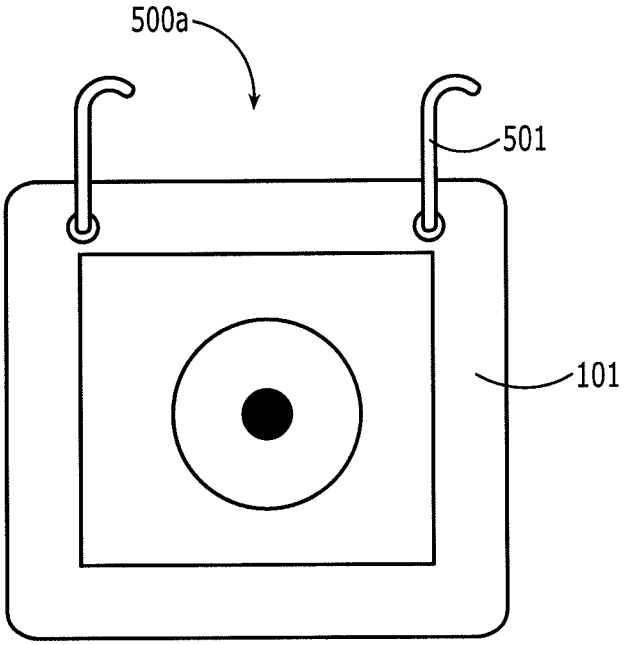
FIGS. 5(*a*)-(*b*) show alternative embodiments of the support mechanism for the portable target of the present invention.
Figure 5B:
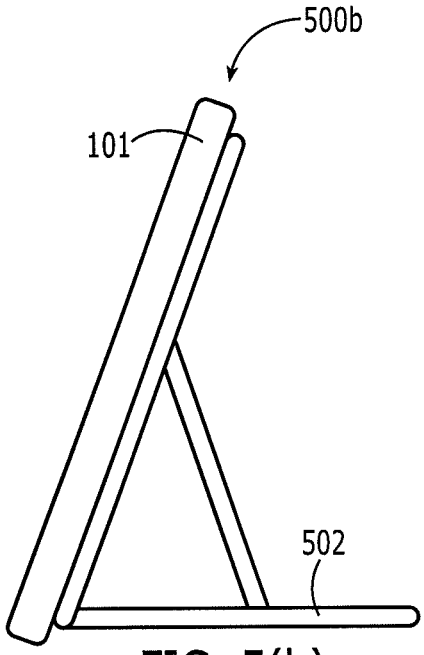

The support mechanism may also include a fastener to attach the backer to a stationary structure, and may include, for example, hooks 501, as shown in the target 500*a* of FIG. 5(*a*), a rope 110 as shown in FIG. 1, or a nail or similar structure for fastening to the stationary object. In yet another embodiment of the target 500*b*, the support mechanism may be a stand 502 such as shown in FIG. 5(*b*). The stand 502 may be configured to fold out in a way similar to that of a photograph frame. Still other embodiments of a stand will be known to those of skill in the art. It is preferred, although not necessary, that the stand be collapsible or modular such that it is easily stowed.

Another aspect of the invention is a method of using a portable target. In one embodiment, the method comprises unfurling the backer 101, securing the target 102 to one side of the backer 101, and hanging the backer to an object in the field. In one embodiment, arrows are used in which the tips are replaced with flat tips to avoid damage to the backer. Flat tips are well known in the art and are interchangeable with broad tips and field tips such that the performance of the arrow in the air is unaffected.

The size of the target can be customized for the particular application. Generally, portability will be a key consideration, and, accordingly, the target should be small enough to be rolled or folded and fit into a backpack or similar luggage.

What is claimed is:

1. A portable target comprising:

a complaint, energy-absorbing backer, said backer being sufficiently compliant to be folded or rolled, said backer comprising a material having a toughness sufficient to withstand being puncturing by an arrow with a flat tip traveling no less than 250 feet per second;

a target attached directly on a surface of said backer; and a support mechanism for holding said surface of said backer in a vertical position.

2. The portable target of claim 1, wherein said backer comprises a film of a polymeric material.

3. The portable target of claim 1, wherein said backer comprises a woven or a nonwoven material comprising a resilient fiber.

4. The portable target of claim 3, wherein said resilient fiber is poly-paraphenylene terephthalamide.

5. The portable target of claim 1, wherein said backer comprises canvas.

6. The portable target of claim 1, wherein said backer is configured as a bag to hold complaint material.

7. The portable target of claim 1, wherein said target is disposable.

8. The portable target of claim 1, further comprising an attachment mechanism for securing said target to said backer.

9. The portable target of claim 8, wherein said attachment mechanism is a releasable adhesive between said backer and said target.

10. The portable target of claim 9, wherein said releasable adhesive is applied to a rear surface of said target.

11. The portable target of claim 8, wherein said attachment mechanism comprises at least one clip on said backer to clip and hold said target.

12. The portable target of claim 1, wherein said target comprises pressure-sensitive marker.

13. The portable target of claim 1, wherein said target is a distinctively different color or shade than said backer.

14. The portable target of claim 1, wherein said target has a bull's eye and concentric rings at a quantified distance from said bull's eye.

15. The portable target of claim 1, wherein said support mechanism comprises a purchase point on said backer to support said backer in a vertical position.

16. The portable target of claim 15, wherein said purchase point is a grommet.

17. The portable target of claim 16, wherein said support mechanism further comprises a fastener to connect said purchase point to a stationary object.

18. The portable target of claim 1, wherein said material has a toughness sufficient to withstand being puncturing by an arrow with a flat tip traveling no less than 350 feet per second.

19. A method of calibrating a sight of a bow in the field, said method comprising:

unfurling a rolled or folded backer of a portable target, said backer comprising a material having a toughness sufficient to withstand being puncturing by an arrow with a flat tip traveling no less than 250 feet per second;

attaching a target to said backer such that said target in directly on a side of said backer;

supporting said backer in a vertical position;

while standing a certain distance away from said target, shooting an arrow with a flat tip at a certain point in said target;

measuring the distance between said certain point and a point of impact of said arrow; and adjusting said sight based on said distance.

20. The method of claim 19, wherein supporting said backer comprises hanging said backer from a stationary object.

21. The method of claim 19, wherein said material has a toughness sufficient to withstand being puncturing by an arrow with a flat tip traveling no less than 350 feet per second.

* * * * *